United States Patent [19]

Hirakawa et al.

[11] Patent Number: 4,644,896

[45] Date of Patent: Feb. 24, 1987

[54] LOWER ROLL APPARATUS FOR SINGLE FACER

[75] Inventors: Tadashi Hirakawa; Hiroaki Sasashige; Haruo Okawa, all of Mihara, Japan

[73] Assignee: Mitsubishi Jukogyo Kabushiki Kaisha, Tokyo, Japan

[21] Appl. No.: 769,360

[22] Filed: Aug. 23, 1985

[51] Int. Cl.[4] ..... B05C 1/08

[52] U.S. Cl. ..... 118/44; 118/70; 118/249; 15/304; 156/473

[58] Field of Search ..... 15/304, 306 A; 156/473; 118/70, 245, 44, 249

[56] References Cited

U.S. PATENT DOCUMENTS

| | | | |
|---|---|---|---|
| Re. 31,138 | 2/1983 | Tokuno | 156/473 |
| 4,253,903 | 3/1981 | McDonald | 156/473 X |
| 4,368,094 | 1/1983 | Mayer et al. | 156/473 X |

*Primary Examiner*—John P. McIntosh

*Attorney, Agent, or Firm*—Wenderoth, Lind & Ponack

[57] ABSTRACT

A lower roll apparatus for a single facer includes a nozzle-equipped scraper constituted by a scraper and a nozzle which are integrated with each other. The nozzle-equipped scraper is inerted into a circumferential groove formed on a lower roll and is disposed at the position closest to a suction bore formed in the lower roll. The apparatus is further provided with a steam or compressed air source for supplying the nozzle with steam or compressed air. The nozzle-equipped scraper is arranged such as to be pivotal so that the nozzle is separated from the circumferential groove.

7 Claims, 9 Drawing Figures

LOWER ROLL APPARATUS FOR SINGLE FACER

BACKGROUND OF THE INVENTION

1. Field of the Invention

The present invention relates to a lower roll apparatus for a single facer.

2. Description of the Prior Art

A lower roll apparatus for a conventional single facer will first be described with reference to FIGS. 1 to 5.

A lower roll 5 which is shown in FIG. 1 has its outer peripheral surface provided with corrugated grooves 5*a* which extend axially thereof and circumferential grooves 5*b* which extend circumferentially thereof, as shown in FIG. 2. The roll cell of the lower roll 5 is formed with horizontal bores 5*d* which extend axially thereof. The horizontal bores 5*d* are respectively communicated with the valley portions of the circumferential grooves 5*b* through respective suction bores 5*e*. On the other hand, suction boxes 12 are respectively provided in close proximity to the right and left ends of the lower roll 5. The suction boxes 12 and the corresponding outer end surfaces of the lower roll 5 are hermetically connected through respective disk plates 11. Both shaft portions 5*c* of the lower roll 5 are rotatably supported by a frame (not shown) in such a manner that both the outer end surfaces of the lower roll 5 are in slide contact with the respective side surfaces of the disk plates (see FIGS. 3 and 4).

FIG. 5 schematically shows the process of manufacturing a single-faced corrugated sheet in a conventional single facer. In the Figure, the reference numeral 5 denotes a lower roll having the above-described structure. An upper roll 4 has its outer peripheral surface provided with corrugated grooves 4*a* similar to those formed on the outer peripheral surface of the lower roll 5. The reference numeral 6 represents a pressure roll, 7 a gluing roll, 8 a glue reservoir, 9 glue, and 10 a scraper.

A core paper sheet 1 is fed in the direction of the arrow and is shaped into a corrugated sheet 1*a* while passing through the engagement area between the upper and lower rolls 4 and 5, and the glue 9 is attached to the crests of the corrugations of the sheet 1*a* by the gluing roll 7 as shown by the reference numeral 9*a*. On the other hand, a liner 2 which is fed in the direction of the arrow is press-bonded to the core paper sheet 1*a* while passing through the engagement area between the pressure roll 6 and the lower roll 5 to form a single-faced corrugated sheet 3, which is fed to a subsequent step.

During such a process, the core paper sheet 1*a* is held to the surface of the lower roll 5 by means of suction over a range corresponding to an angle $\theta$ shown in FIG. 3. However, when such a suction operation is carried out continuously, the suction bores 5*e* gradually become clogged with paper powder and the glue 9, causing the suction effected to be gradually decreased. Finally, the core paper sheet 1*a* is undesirably fed to the gluing roll 7 in a state wherein it is not completely suction-attached to the lower roll 5, resulting disadvantageously in a single-faced sheet which is incompletely corrugated. For this reason, it has been inconveniently necessary in order to prevent this clogging phenomenon to suspend operation of the machine and to clean the bores 5*d* and 5*e* manually. Further, a large number of defective sheets may disadvantageously be produced due to this clogging phenomenon.

To prevent clogging of the suction bores so as to maintain a required level of productivity, it is general practice to periodically clean the suction bores manually. However, since there are a large number of suction bores, much time is disadvantageously required for cleaning.

SUMMARY OF THE INVENTION

Accordingly, it is a primary object of the present invention to provide a novel lower roll apparatus for a single facer which eliminates the need for manual maintenance and prevents the lowering of the level of productivity which would otherwise be caused by clogging of the suction bores.

To this end, the present invention provides a novel lower roll apparatus for a single facer in which a conventional type of scraper is integrally formed with a nozzle by means of precision casting. The nozzle is inserted into a suction groove which is formed in the lower roll so as to jet out steam or compressed air from the position closest to the suction bores, thereby preventing the clogging of the suction bores. When steam or compressed air is not jetted out, the nozzle portion is separated from the suction groove for the purpose of preventing wearing of the nozzle portion, thereby prolonging the life of the nozzle.

The above and other objects, features and advantages of the present invention will become clear from the following description of the preferred embodiment thereof, taken in conjunction with the accompanying drawings.

DESCRIPTION OF THE PREFERRED EMBODIMENT

One embodiment of the present invention will be described hereinunder with reference to the accompanying drawings.

Figure 1:
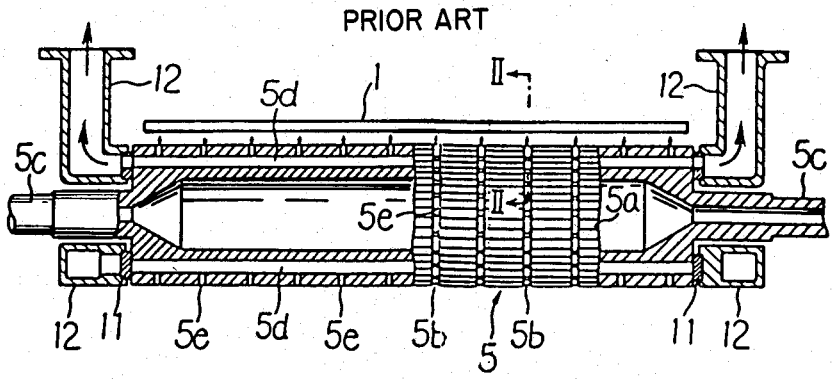
FIG. 1 PRIOR ART
FIG. 1 is a sectional front elevational view of a lower roll apparatus for a conventional single facer.
Figure 2:
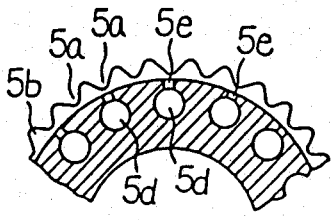
FIG. 2 PRIOR ART
FIG. 2 is a sectional view taken along the line II—II of FIG. 1.
Figure 3:
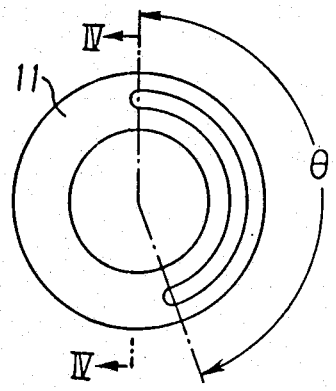
FIG. 3 PRIOR ART
FIG. 3 is a side elevational view of one of the disk plates shown in FIG. 1.
Figure 4:
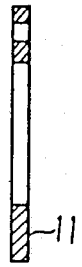
FIG. 4 PRIOR ART
FIG. 4 is a sectional view taken along the line IV—IV of FIG. 3.

FIGS. 6 to 9 schematically show in combination the structure of a lower roll apparatus for a single facer in accordance with one embodiment of the present invention. The configuration of the lower roll 5 shown in FIG. 6 and the method of carrying out the same are similar to those explained with reference to FIG. 1.

A suction bore cleaning means comprising a scraper 20 equipped with a nozzle 20*a* is supported by movable support means comprising a support shaft 21, which is parallel to the axis of rotation of the lower roll 5, and a swing shaft 22, whereby the scraper and nozzle are inserted into each of the circumferential grooves 5*b* of the lower roll. When the swing shaft 22 is raised upwardly, the nozzle 20*a* is separated from the circumferential groove 5*b*. A piping system means which supplies steam or compressed air to the nozzle 20*a* comprises a valve 23, a manifold 24 and a flexible hose 25. The manifold 24 is provided with a multiplicity of distributing pipes so that it is possible for steam or compressed air to be supplied to the nozzle-equipped scrapers 20 which are respectively disposed at the circumferential grooves 5*b* of the lower roll 5. Each scraper 20 has on either side three flat edges in a plane which is perpendicular to the roll axis of the lower roll with the fourth edge being arcuate in shape for being received in the circumferential groove, the thickness of the scraper being less than the width of the circumferential groove 5*b*. The nozzle 20*a* has an opening which passes through a surface of the scraper at a position between the arcuate side edges thereof.

Figure 5:
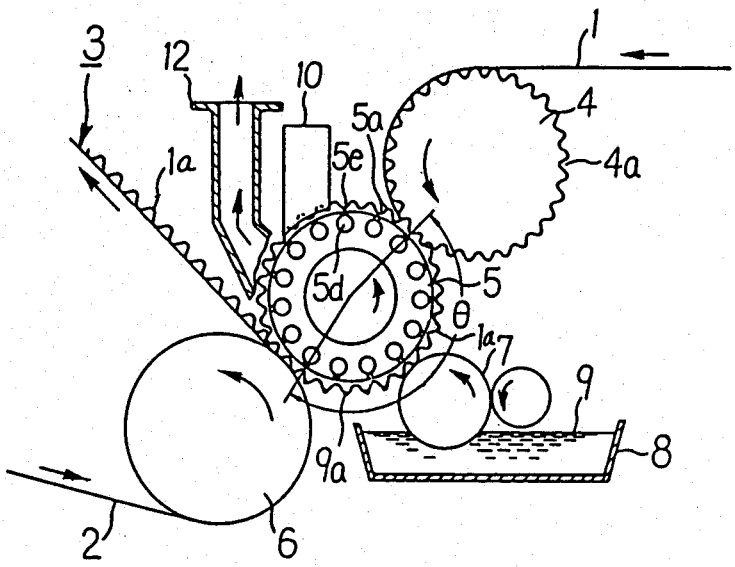
FIG. 5 PRIOR ART
FIG. 5 is a sectional side elevational view of a conventional single facer.
Figure 6:
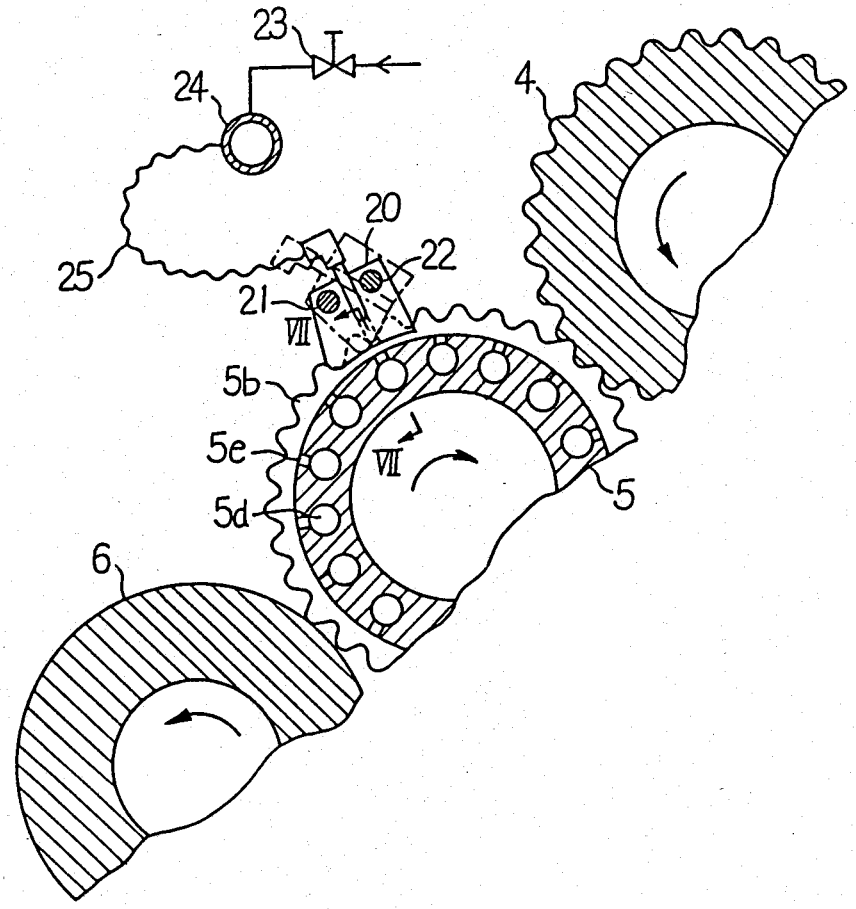
FIG. 6 is a fragmentary sectional side elevational view of a lower roll apparatus for a single facer in accordance with one embodiment of the present invention.
Figure 7:
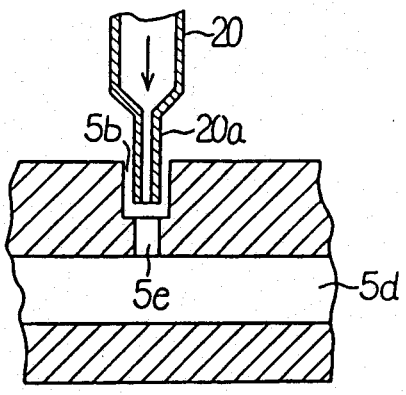
FIG. 7 is an enlarged sectional view taken along the line VII—VII of FIG. 6.
Figure 8:
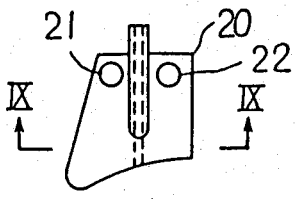
FIG. 8 is a side elevational view of the nozzle-equipped scraper shown in FIG. 6.
Figure 9:
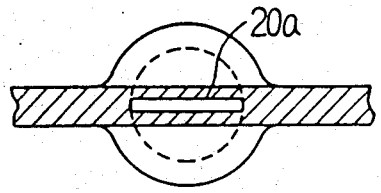
FIG. 9 is an enlarged sectional view taken along the line IX—IX of FIG. 8.

Further, each scraper 20, which is supported by the support shaft 21 and the swing shaft 22, is adapted to be easily movable axially of the shafts 21 and 22, so that it is possible to set the nozzle 20*a* at a position where it does not contact any element or portion, as shown in FIG. 7. However, steam or the like is introduced into the lower roll 5 in operation and the roll 5 is thereby heated to a high temperature. In consequence, the roll 5 is thermally expanded axially thereof, which fact involves a risk of the nozzle 20*a* contacting the side surfaces of the circumferential groove 5*b* and thus causing the nozzle 20*a* to become worn. However, it is possible according to this embodiment to separate the nozzle 20*a* from the edges of circumferential groove 5*b*. It is therefore possible to prevent the wear of the nozzle 20*a* and also prevent the nozzle 20*a* from becoming clogged with any glue which may be transferred from the gluing roll 7 (shown in FIG. 5) to the lower roll 5 and attached to the circumferential groove 5*b*.

The following is a description of the operation of the above-described embodiment.

First, when the valve 23 is opened, steam or compressed air enters the manifold 24 where it is distributed among the nozzle-equipped scrapers 20. The steam or compressed air then jets out from the nozzle 20*a* at the distal end of each scraper 20 in such a manner as to blow away the glue and paper dust caught in the suction bore 5*e*, thereby preventing the bore 5*e* from becoming clogged. When it is not necessary to clean the suction bore 5*e*, that is, when no steam or compressed air is supplied to the nozzle 20*a*, the valve 23 is closed, and the swing shaft 22 is raised upwardly. Thereupon, the nozzle 20*a* is separated from the circumferential groove 5*b*, and wear of the nozzle 20*a* is thus prevented. It is to be noted that, even when the swing shaft 22 is raised, a portion of the scraper 20 is still received in the circumferential groove 5*b*; and a forward side edge surface of the scraper extends from the portion in the circumferential groove 5*b* even when the nozzle 20*a* is removed from the groove 5*b* to prevent the core paper sheet 1*a* from undesirably coiling round the lower roll 5).

Since the present invention is arranged in the manner as described above in detail, when steam or compressed air is blown against each suction bore from the associated nozzle, the glue and paper dust caught in the suction bore are blown away by the pressure and jet of the steam or the like. Accordingly, it is advantageously possible to eliminate the need for wasteful labor and time which have heretofore been required in manually cleaning a multiplicity of suction bores using, for example, a suction bore cleaning jig. Further, since it is possible to pivot the nozzle-equipped scraper such as to separate it from the circumferential groove when no steam or compressed air is supplied, the nozzle can be protected from becoming worn. Moreover, it is advantageously possible to prevent the nozzle from becoming clogged with glue.

Although the invention has been described through specific terms, it is to be noted here that the described embodiment is not limitative and various changes and modifications may be imparted thereto without departing from the scope of the invention which is limited solely by the appended claims.

What is claimed is:

1. A lower roll apparatus for a single facer, comprising:

frame means;

a lower corrugated roll rotatably mounted on said frame means, said lower roll rotatable about a roll axis and having at least one circumferential groove formed on a radially outer peripheral surface thereof, a plurality of suction bores opening at one end thereof into said at least one circumferential groove, the other end of said suction bores being in fluid communication with a source of suction for holding a core paper sheet to said outer peripheral surface of said lower roll during a single facing operation;

at least one suction bore cleaning means for blowing compressed air or steam into a respective circumferential groove of said lower roll to clean said suction bores, said suction bore cleaning means comprising a nozzle and movable support means mounted on said frame means for positioning said nozzle into and out of said respective circumferential groove; and a piping system means connected between said nozzle and a source of compressed air or steam for selectively supplying either compressed air or steam to said at least one circumferential groove to thereby blow away glue and paper dust caught in said suction bores.

2. The lower roll apparatus of claim 1, wherein a separate suction bore cleaning means is provided for cleaning the suction bores of each of a plurality of circumferential grooves on said lower roll.

3. The lower roll apparatus of claim 1, wherein said movable support means of said suction bore cleaning means moves said nozzle axially with respect to said lower roll and moves said nozzle into and out of said respective circumferential groove.

4. The lower roll apparatus of claim 3, wherein said movable support means comprises a first shaft supported on said frame means and which extends in a direction parallel to said roll axis, said suction bore cleaning means being pivotably mounted on said first shaft and movable axially along said first shaft.

5. The lower roll apparatus of claim 4, wherein said movable support means includes a second shaft which is parallel to said first shaft, said second shaft connected to said suction bore cleaning means for pivoting said suction bore cleaning means about said first shaft.

6. The lower roll apparatus of claim 1, wherein said suction bore cleaning means includes a scraper having two flat sides which are perpendicular to said roll axis, each of said sides having an arcuate edge which is received in said respective circumferential groove, said scraper having a thickness which is less than the width of said respective circumferential groove, said nozzle extending between said sides of said scraper and having an opening passing through a surface of said scraper extending between said arcuate edges of said two flat sides thereof.

7. The lower roll apparatus of claim 6, wherein said scraper has a forward side edge surface which extends outwardly from said respective circumferential groove to prevent the core paper sheet from coiling around the lower roll when said nozzle is positioned into and out of said respective circumferential groove.

* * * * *